US008405585B2

(12) United States Patent
Wang et al.

(10) Patent No.: US 8,405,585 B2
(45) Date of Patent: Mar. 26, 2013

(54) OLED DISPLAY, INFORMATION DEVICE, AND METHOD FOR DISPLAYING AN IMAGE IN OLED DISPLAY

(75) Inventors: Shou-Cheng Wang, Zhubei (TW); Du-Zen Peng, Zhubei (TW)

(73) Assignee: Chimei Innolux Corporation, Chu-nan (TW)

( * ) Notice: Subject to any disclaimer, the term of this patent is extended or adjusted under 35 U.S.C. 154(b) by 1095 days.

(21) Appl. No.: 12/006,622

(22) Filed: Jan. 4, 2008

(65) Prior Publication Data

US 2009/0174628 A1 Jul. 9, 2009

(51) Int. Cl.
*G09G 3/32* (2006.01)

(52) U.S. Cl. ..... 345/82; 345/76; 345/204

(58) Field of Classification Search ..... 345/76–83, 345/204

See application file for complete search history.

(56) References Cited

U.S. PATENT DOCUMENTS

| | | | | |
|---|---|---|---|---|
| 7,161,566 | B2 * | 1/2007 | Cok et al. | 345/76 |
| 2002/0167474 | A1 * | 11/2002 | Everitt | 345/82 |
| 2003/0122749 | A1 * | 7/2003 | Booth et al. | 345/82 |
| 2005/0088379 | A1 * | 4/2005 | Tsuchida | 345/76 |
| 2007/0001941 | A1 | 1/2007 | Umezaki et al. | |
| 2008/0174530 | A1 * | 7/2008 | Booth et al. | 345/82 |
| 2008/0191976 | A1 * | 8/2008 | Nathan et al. | 345/76 |
| 2008/0224966 | A1 * | 9/2008 | Cok et al. | 345/82 |

FOREIGN PATENT DOCUMENTS

CN 1892768 6/2010

* cited by examiner

*Primary Examiner* — Viet Pham
(74) *Attorney, Agent, or Firm* — Liu & Liu

(57) ABSTRACT

An OLED display including a display panel, a memory, and a processing circuit is provided. The display panel includes a plurality of sub-pixels. The memory stores a compensation table. The processing circuit includes a current sensor, and a processor. The current sensor sense a current of at least one sub-pixel among said plurality of sub-pixels, and the compensation table is updated according to the sensed current. The processor receives image data and generates compensated image data based on the image data and the updated compensation table. Then the display panel displays said compensated image data.

19 Claims, 5 Drawing Sheets

OLED DISPLAY, INFORMATION DEVICE, AND METHOD FOR DISPLAYING AN IMAGE IN OLED DISPLAY

FIELD OF INVENTION

The invention relates to an organic light emitting diode (OLED) display, an information device having an OLED display, and a method for displaying an image in an OLED display.

BACKGROUND OF THE INVENTION

OLED displays require no backlight, and are therefore optimum for thin formation, with no limitation of viewing angle. Thus, OLED displays have become popular substitutes for cathode ray tube (CRT) and liquid crystal display (LCD) devices.

One problem using organic light emitting elements is Mura defect, which is caused mainly by inconsistent luminance of the organic light emitting elements. Luminance of an organic light emitting element is determined in a manufacturing process and degrades with time. The rate of luminance decay of an organic light emitting element depends especially on characteristics of the organic light emitting element, conditions in a manufacturing process, how the organic light emitting element is driven, and other conditions.

Mura defects can be aggravated in full-color OLED display panels that emit red, green, and blue light. The organic light emitting elements of varying colors have different rates of luminance decay. The differences in luminance between the organic light emitting elements of a plurality of colors typically become more apparent with time.

In addition to Mura defects, an OLED display (particularly, the Electro Luminescent (EL) materials) will age and become less efficient at emitting light, reducing the lifetime of the display. The aging of the OLEDs is related to the cumulative current passed through the OLED resulting in reduced performance, also the aging of the OLED material results in an increase in the apparent resistance of the OLED that causes a decrease in the current passing through the OLED at a given voltage. The decrease in current is directly related to the decrease in luminance of the OLED at a given voltage. In addition to the OLED resistance changing with use, the light emitting efficiency of the organic materials is reduced. The different materials may age at different rates, causing "differential color aging" and thus the "shift of white point". Moreover, each individual pixel may age at different rate than others, resulting in display non-uniformity or so-called "image sticking".

Conventionally, the Mura defects and the aging of the OLEDs are addressed in separate ways, which make the circuit design complicated and increases the production cost. Therefore, it is desired to have an OLED display and a method for displaying an image in an OLED display, which can compensate the "non-uniformity" resulted from either the Mura defects or the material aging.

SUMMARY OF THE INVENTION

The present invention is directed to an OLED display prestoring a compensation table, and is also directed to a method for displaying an image in the OLED display. In one aspect of the present invention, the current sensor senses a current of at least one sub-pixel among the plurality of sub-pixels, and the compensation table is updated according to the sensed current. Later the processor receives image data and generates compensated image data based on the image data and the updated compensation table. Then the display panel displays the compensated image data.

The foregoing and other features of the invention will be apparent from the following more particular description of embodiment of the invention.

BRIEF DESCRIPTION OF THE DRAWINGS

The present invention is illustrated by way of example and not intended to be limited by the figures of the accompanying drawing, in which like notations indicate similar elements.

DETAILED DESCRIPTION

The present invention is useful for both top-emitting OLED display devices (those that emit light through a cover placed above a substrate on which the OLED is constructed) and bottom-emitting OLED display devices (those that emit light through the substrate on which the OLED is constructed). Moreover, this invention is advantageously practiced with, but not limited to, both top-emitting and bottom-emitting OLED active matrix devices.

Figure 1:
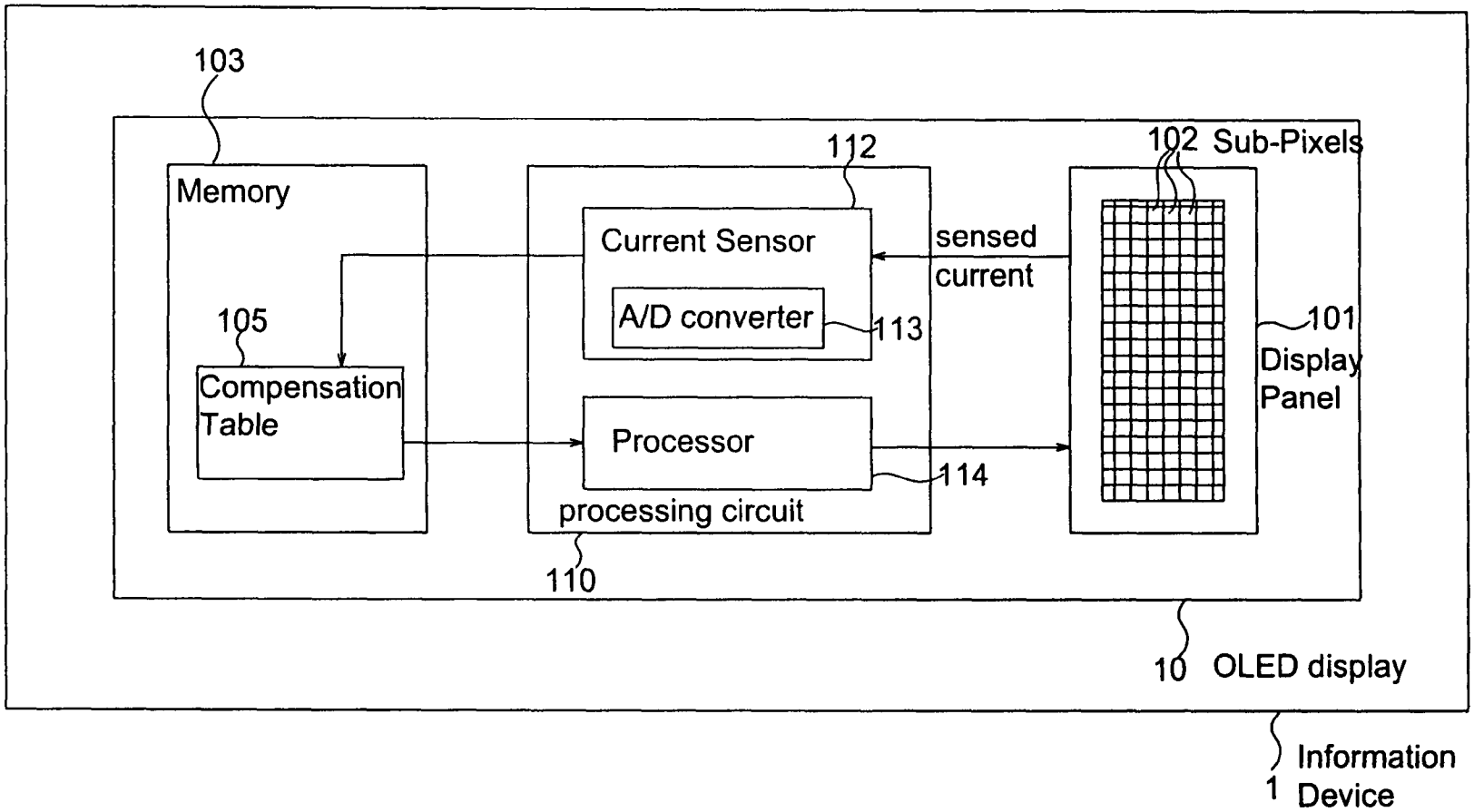
FIG. 1 is a block diagram of an information device with an OLED display according to an embodiment of the present invention.

FIG. 1 is a block diagram of an information device 1 with an OLED display 10 according to an embodiment of the present invention. In this embodiment, the OLED display 10 is a color image display integrated into the information device 1. As known to those skilled in the art, the information device 1 can be a mobile phone, a digital camera, a personal digital assistant (PDA), a notebook computer, a desktop computer, a television, a car media player, a portable video player, a digital camera, a global positioning system (GPS), or a avionics display, etc.

As shown in FIG. 1, the OLED display 10 includes a display panel 101, a memory 103, and a processing circuit 110. The display panel 101 includes a plurality of sub-pixels 102 of different colors (e.g. red, green and blue), and sub-pixels 102 are individually controlled by the processing circuit 110 to present a color image (the details will be described below). The number of sub-pixels 102 depends on the requirements of the information device 1 and is not limited in the present invention. Note that colored sub-pixels 102 may be formed by different organic light emitting materials that emit light of different colors, or they may all be formed by the same organic white light emitting materials with color filters over the individual elements to produce the different colors.

The memory 103, which may be embodied as a flash memory, a SRAM, or a DRAM, is provided for storing and maintaining a compensation table 105. Initially, the compensation table 105 is established based on the characteristic of each sub-pixel 102 and the average luminance of the all sub-pixels 102. With a given test signal provided to each sub-pixel 102, the characteristics of each sub-pixel 102 are determined according to the luminance, or the currents of each sub-pixel 102. For example, the electric characteristic of each sub-pixel 102 can be measured by a thin film transistor (not shown) connected to each sub-pixel 102, or the optical characteristic can be measured by a photo sensor (not shown) provided to each sub-pixel 102. Due to the manufacturing process and other factors known to those skilled in the art, each sub-pixel may not have uniform characteristics, and thus results in different emitting performances. Then by mapping the characteristics of each sub-pixel 102 with regard to the average luminance of all sub-pixels 102, the compensation parameter for each sub-pixel 102 are estimated, and the compensation table 105 including the estimated compensation parameter for each sub-pixel 102 is further written into and kept in the memory 103. Later when the information device 1 has an image to display, the processing circuit 110 will consult the compensation table 105 to drive each sub-pixel 102 with different voltages in order to display the image correctly, whereby the Mura defect is eliminated. Moreover, those skilled in the art can understand that the compensation table 105 can be established in other ways, and all of them are covered by the present invention.

The processing circuit 110, which can be embodied as an Application Specific Integrated Circuit (ASIC), includes a current sensor 112, and a processor 114 integrated thereon. The processing circuit 110 shown in FIG. 1 is provided for an exemplary purpose, and the current sensor 112 and the processor 114 can be implemented in a different way from FIG. 1, for example, in two separate circuits. Each time when the current sensor 112 is activated, it senses a current of at least one sub-pixel among the plurality of sub-pixels 102 at a given voltage. The current sensor 112 further includes an analog to digital (A/D) converter 113 to generate a value representing the sensed current. Then a predetermined relationship, which characterizes the aging of that at least one sub-pixel 102, is referred to with the value of the sensed current, in order to determine an updated compensation parameter for that at least one sub-pixel 102, which is to replace the previous compensation parameter in the compensation table 105. Later when the information device 1 has an image to display, the processing circuit 110 receives the "raw" image data from a data source (not shown in FIG. 1) and consults the updated compensation table 105 to drive that at least one sub-pixel 102 with an adjusted voltage in order to display the image correctly, whereby the aging of OLED will not be perceived by the user. The information device 1 is thus advantageous relative to the prior art because it uses the compensation table 105 to address both Mura defect and the aging of OLED. In this embodiment, in order to compensate process-related Mura defect and the aging of OLED, the initial compensation parameter for each sub-pixel is essential and must be referred to for the later update of the compensation table; otherwise the EL aging might be compensated but the Mura defect due to TFT non-uniformity would still be revealed after the update.

Figure 2:
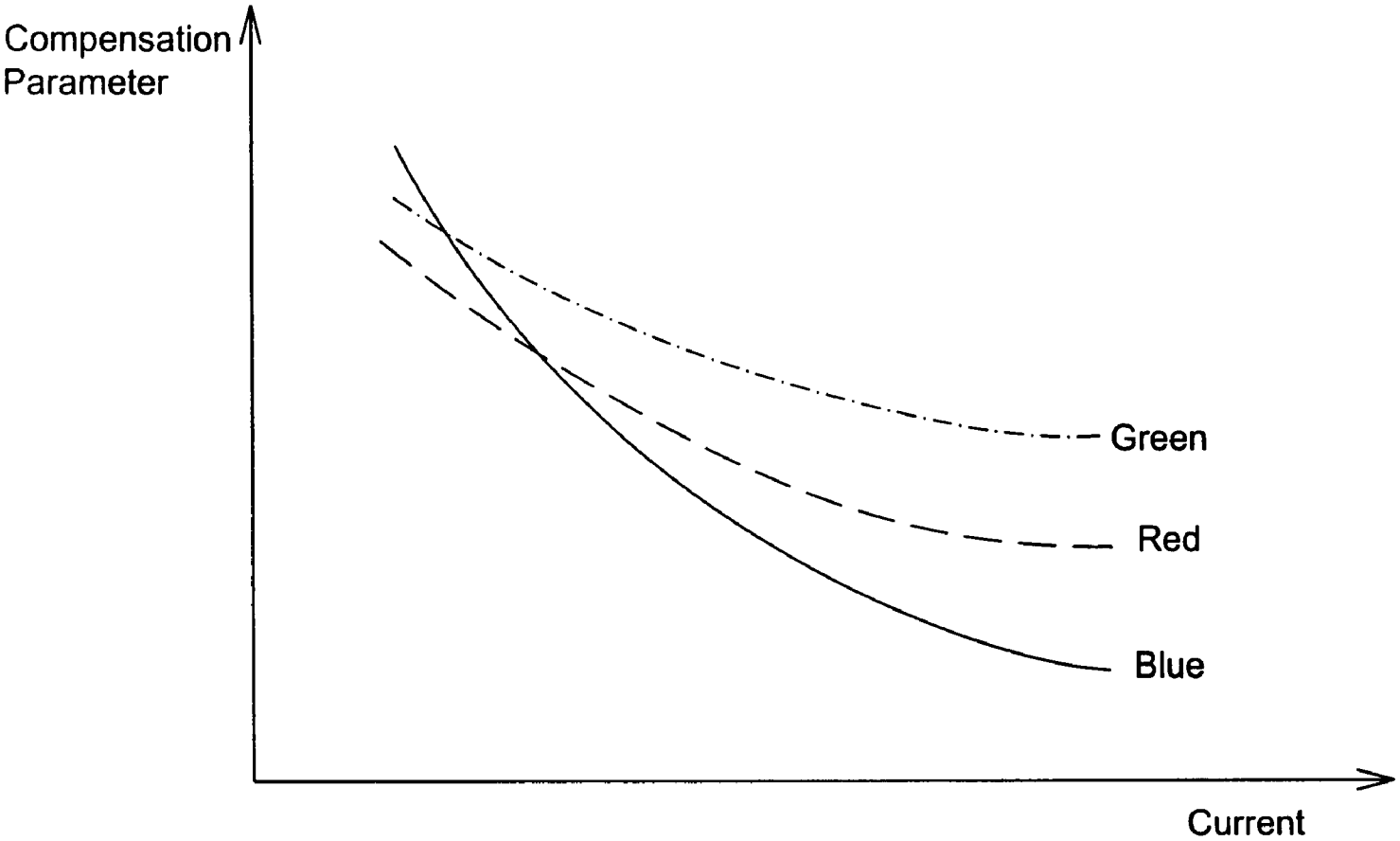
FIG. 2 exemplarily shows predetermined relationships between the sensed current and the compensation parameter for sub-pixels of Red, Green, and Blue.

The exemplary predetermined relationships are shown as the curves in FIG. 2, wherein when the sensed current is getting smaller because of the increasing resistance of the OLED sub-pixel 102, a larger compensation parameter is required to correctly display image data. Note that the predetermined relationships (the curves) are associated with the colors of the sub-pixel because the OLED aging may different to the colors. In other words, as shown in FIG. 2, different curves are applied to the sub-pixels of red, green, or blue (R, G, B). Besides, the predetermined relationships can also be associated with the operation temperature of OLED device, the EL material and/or usage frequency. Therefore, according to the predetermined relationships, the processor 114 can always refer to a suitable curve, judge the compensation strength, and update the compensation table. In addition, the predetermined relationship can be stored in the memory 103 or implemented in the current sensor 112 or in the processing circuit 110, which is not important to the present invention.

Figure 3:
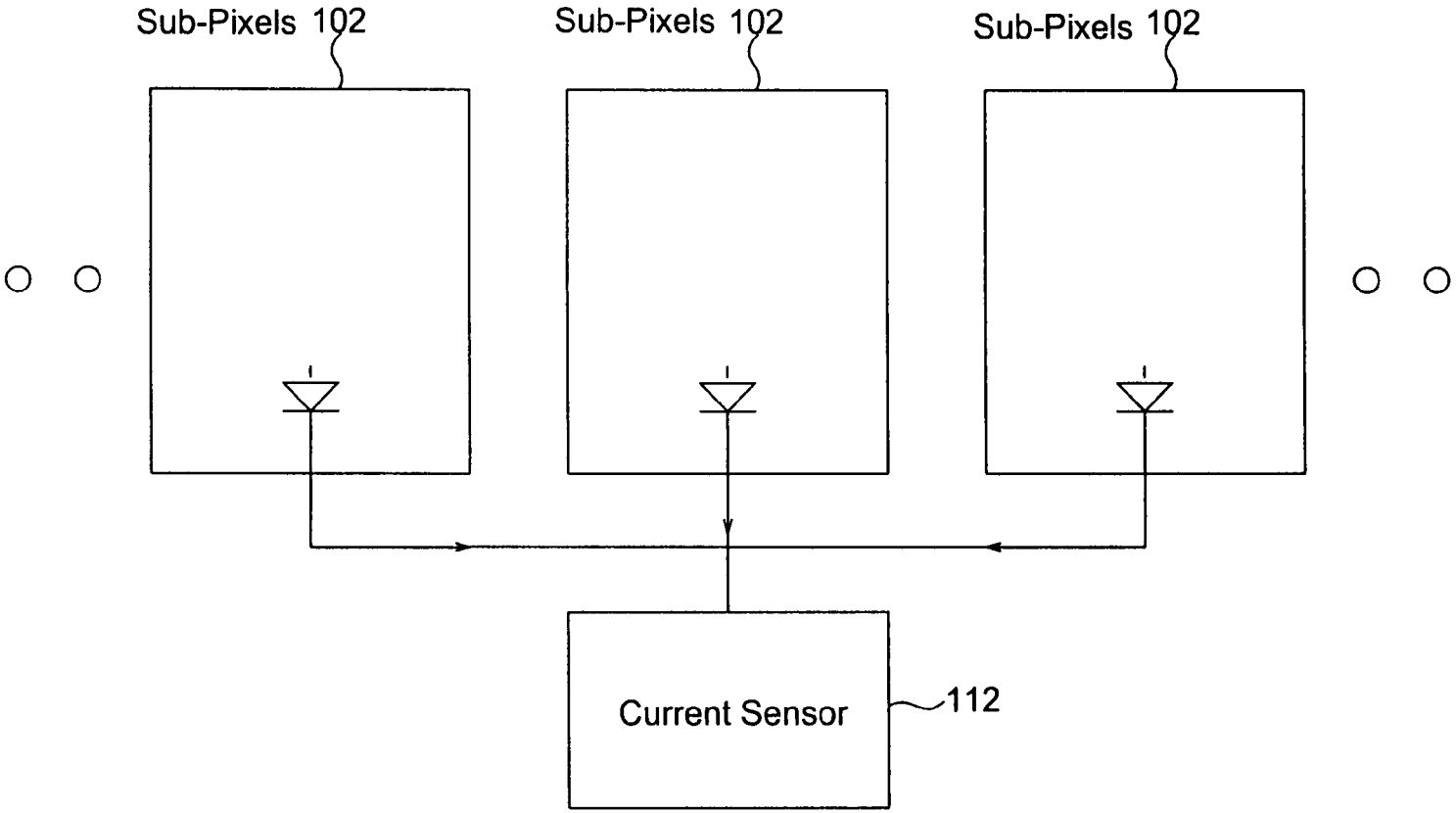
FIG. 3 illustrates that a current sensor senses a sum of currents at cathodes of several sub-pixels, according to an embodiment of the present invention.

In another embodiment, each time when the current sensor 112 is turned on, it senses the currents of each individual sub-pixel 102 of the display panel 101; then following a procedure similar to the one described above, the compensation parameters for each sub-pixel 102 in the compensation table 105 are adjusted according to the aforementioned predetermined relationships. The updating of the compensation table 105 is performed for all sub-pixels 102, but it may take longer time to complete. In yet another embodiment that is more efficient, the current sensor 112 is provided for sensing a sum of currents of a group of pixels 102 by sensing the sum of currents at cathodes of the group of sub-pixels 102, as shown in FIG. 3, rather than for sensing the currents of individual sub-pixel 102. Accordingly, the A/D converter 113 of the current sensor 112 generates a value representing the sum of currents of the group of sub-pixels 102. Then according to the value representing the sum of currents and another predetermined relationship, the compensation parameters for that group of sub-pixels 102 in the compensation table 105 are adjusted together. Because the updating is directed to a group of sub-pixel at once rather than one-by-one, it will take less time. Moreover, since the sensed current of a group of sub-pixel are much larger than the background leakage current, the S/N ratio can be improved comparing to extracting current of single sub-pixel. Note that the group of sub-pixels 102 shown in FIG. 3 include only monochromatic sub-pixels of R, G, or B. But in other embodiment, the group of sub-pixels 102 may have any combination of sub-pixels of R, G, and B.

In still another embodiment, the current sensor 112 sense only the currents (or a sum of the currents) of sub-pixels 102 that are located in a predetermined area of display panel 101, and only the compensation parameters for those sub-pixels 102 in the compensation table 105 are updated, while compensation parameters for other sub-pixels 102 are left intact. The predetermined area is the area where the sub-pixels thereon emit most often, for example, the area where the current date and time are presented.

To avoid the conflict with the normal operation of the display panel 10, the current sensor 112 is activated during the "Idle" mode or the "Screensaving" mode, or even when the information device 1 is charging. In another embodiment, the current sensor 112 is activated according to a user setting. For example, the user inputs a command by a special key (not shown) on the information device 1 to activate the current sensor 112 to sense the current of the sub-pixel(s) 102 and then to update the compensation table 105. Alternatively, the user, via an interface (e.g., a selecting menu, not shown in FIG. 1) of the information device 1, can select an area on the panel 101, whereby the current sensor 112 senses the current(s) and the compensation table 105 is updated for the sub-pixels 102 located within the selected area.

Figure 4:
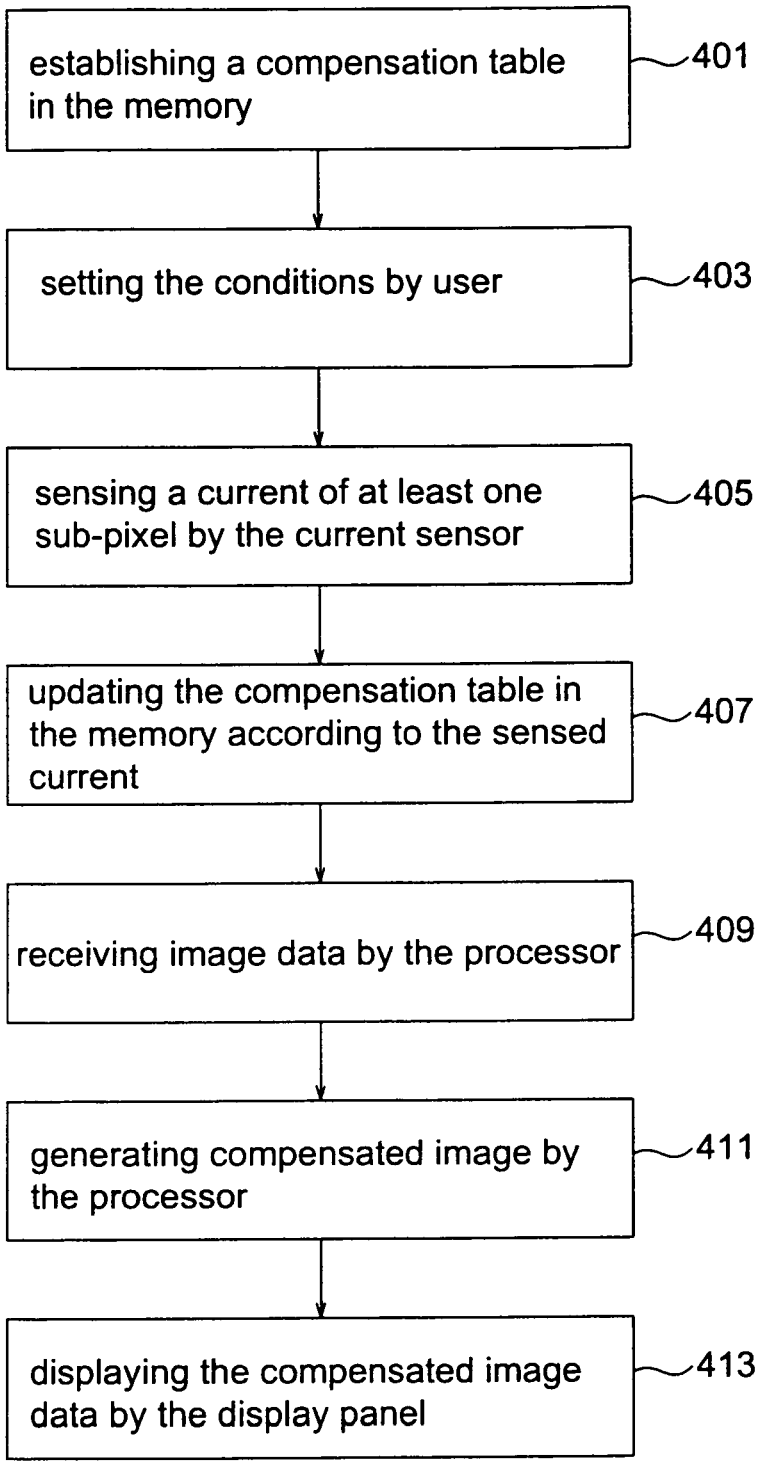
FIG. 4 is a flowchart showing a method for displaying an image according to an embodiment of the present invention.

Based on the provided the information device 1 and the OLED display 10, the present invention further discloses a method for displaying an image. FIG. 4 is a flowchart of the method according to an embodiment. The step 401 is to establish, in the memory 103, a compensation table that includes compensation parameters for each sub-pixel 102 of the display panel 101. For example, like the compensation table 105 shown in FIG. 1, the compensation table in the step 401 is established based on the characteristic of each sub-pixel 102. Then in the step 403, the user sets the conditions for executing the following steps 405 and 407. For example, the user can determine the steps 405 and 407 are executed every time when the information device 1 is charging.

The step 405 is to sense, by the current sensor 112, a current of at least one sub-pixel 102 on the display panel 101, or in another embodiment, to sense the currents of each individual sub-pixel 102 of the display panel 101, or in yet another embodiment, to sense a sum of currents of a group of pixels 102. In the step 407, the compensation table in the memory 103 is updated according to the sensed current and the "current-compensation parameter" curves shown in FIG. 2. After the step 407, when an image is to be displayed, the "raw" image data is received from the data source (not shown) by the processor 114 in the step 409. Then the step 411 is to generate compensated image data by the processor 114 based on the image data and the updated compensation table. Next, the step 413 is to display, by the display panel 101, the compensated image data by driving the sub-pixels 102 with adjusted voltages.

Figure 5:
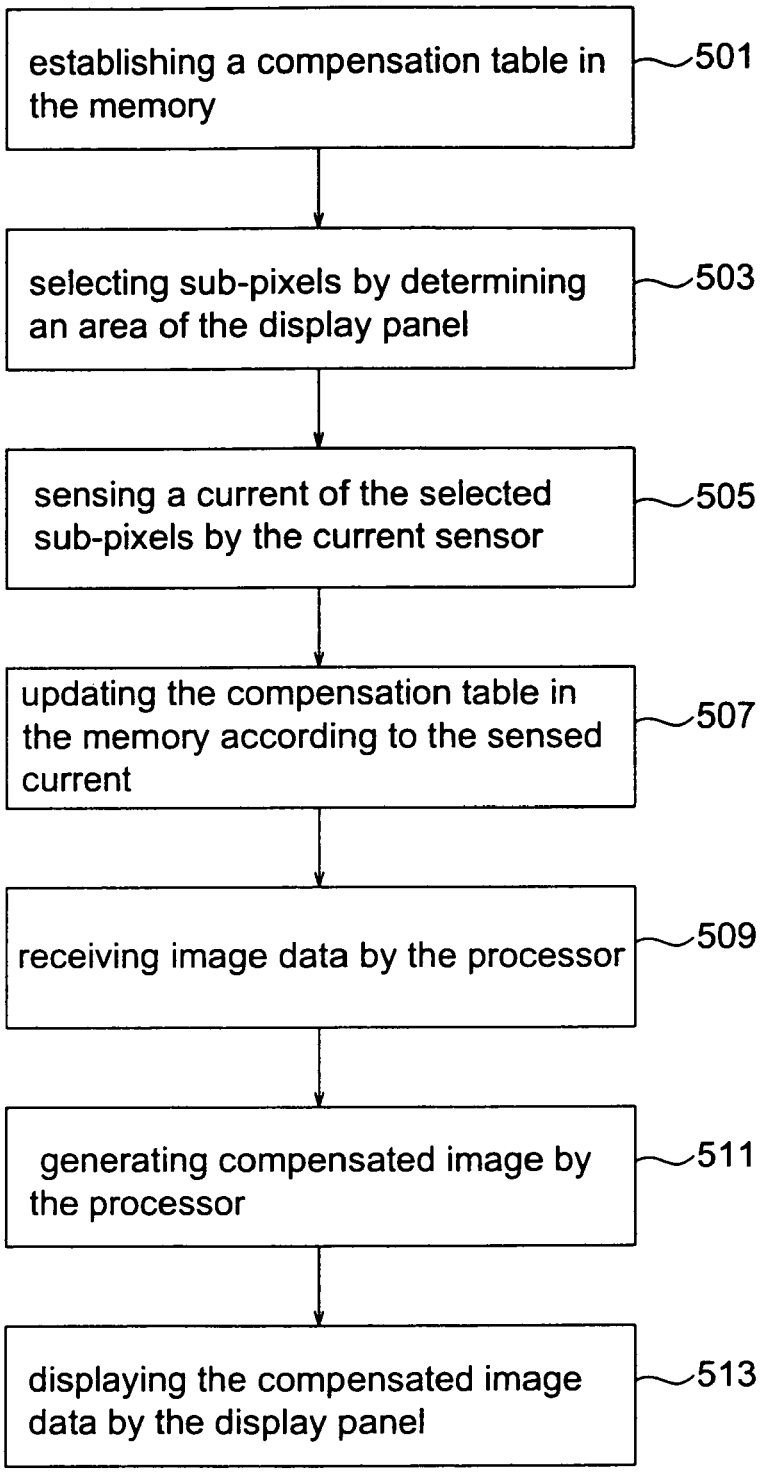
FIG. 5 is a flowchart showing a method for displaying an image according to another embodiment of the present invention.

FIG. 5 shows a method according to another embodiment of the present invention. The step 501, similar to the step 401 in FIG. 5, is to establish a compensation table including compensation parameters in the memory 103. Then in the step 503, the user selects a group of sub-pixels by determining an area of the display panel 101 where those sub-pixels are located, for executing the following steps 505 and 507. For example, the user can determine an area where the sub-pixels thereon emit most often or an area where the compensation parameters for the sub-pixels thereon need to be updated most frequently.

The step 505 is to sense, by the current sensor 112, the currents of each individual sub-pixel located within the determined area in the step 503, or in another embodiment, a sum of currents of all sub-pixel 102 located within selected area. In the step 507, the compensation table in the memory 103 is updated according to the current(s) sensed in the step 505, and the predetermined relationship(s), similar to curves shown in FIG. 2. After the step 507, when an image is to be displayed, the "raw" image data is received from the data source (not shown) by the processor 114 in the step 509. Then the step 511 is to generate compensated image data, by the processor 114, based on the image data and the updated compensation table. Next, the step 513 is to display, by the display panel 101, the compensated image data by driving the sub-pixels with adjusted voltages.

By the embodiments presented above, the present invention provides an OLED display, an information device having an OLED display, and a method for displaying an image in an OLED display, which can compensate the "non-uniformity" resulted from either the Mura defects or the material aging. Meanwhile, the aforementioned "non-uniformity" for a predetermined area of the display can be compensated. Furthermore, the present invention is able to compensate the aforementioned "non-uniformity" according to a user setting, particularly after the OLED display or the information device is delivered to the consumer.

While this invention has been described with reference to the illustrative embodiments, these descriptions should not be construed in a limiting sense. Various modifications of the illustrative embodiment, as well as other embodiments of the invention, will be apparent upon reference to these descriptions. It is therefore contemplated that the appended claims will cover any such modifications or embodiments as falling within the true scope of the invention and its legal equivalents.

The invention claimed is:

1. An OLED display, comprising:

a display panel comprising a plurality of sub-pixels;

a memory storing a compensation table containing information for Mura compensation, wherein said compensation table is initially established based on the characteristic of each sub-pixel and the average luminance of said plurality of sub-pixels; and a processing circuit, comprising:

a current sensor sensing a sum of currents of a group of sub-pixels among said plurality of sub-pixels, wherein said compensation table is updated according to said sensed current; and a processor receiving an image data and generating compensated image data based on said image data and said updated compensation table;

wherein said display panel displays said compensated image data by driving said plurality of sub-pixels, including said at least one sub-pixel that is sensed by the current sensor, to emit light in response to said compensated image data, whereby Mura defect is compensated.

2. The OLED display according to claim 1, wherein said compensation table is updated according to the value of said sensed current and a predetermined relationship.

3. The OLED display according to claim 2, wherein said predetermined relationship is associated with the color of said sub-pixel.

4. The OLED display according to claim 2, wherein said predetermined relationship is associated with the operation temperature, the EL material and/or usage frequency of said sub-pixel.

5. The OLED display according to claim 1, wherein said current sensor is provided for sensing a sum of currents of said plurality of sub-pixels, and said compensation table is updated according to said sum of currents.

6. The OLED display according to claim 5, wherein said plurality of sub-pixels are located in a pre-determined area of said display panel.

7. The OLED display according to claim 6, wherein said compensation table is updated according to the value of said sum of currents and a predetermined relationship, and said predetermined relationship is associated with said pre-determined area.

8. The OLED display according to claim 5, wherein said current sensor senses said sum of currents at cathodes of said plurality of sub-pixels.

9. The OLED display according to claim 1, wherein said current sensor is activated according to a user setting only during a period outside normal operation of the display panel.

10. A method for displaying an image in an OLED display, wherein the OLED display comprises a display panel comprising a plurality of sub-pixels, a memory, a current sensor and a processor, said method comprising:

establishing during manufacturing of the display panel a compensation table in said memory containing information for Mura compensation, wherein said compensation table is initially established based on the characteristic of each sub-pixel and the average luminance of said plurality of sub-pixels;

sensing a sum of currents of a group of sub-pixels among said plurality of sub-pixels by said current sensor;

updating said compensation table in said memory according to said sensed current;

receiving an image data by said processor;

generating, by said processor, compensated image data based on said image data and said updated compensation table; and displaying said compensated image data by said display panel by driving said plurality of sub-pixels, including said at least one sub-pixel that is sensed by the current sensor, to emit light in response to said compensated image data, whereby Mura defect is compensated.

11. The method according to claim 10, wherein the step of updating said compensation table in said memory according to said sensed current comprises: updating said compensation table according to the value of said sensed current and a predetermined relationship.

12. The method according to claim 11, wherein said predetermined relationship is associated with the color of said sub-pixel.

13. The method according to claim 10, wherein the step of sensing a current of at least one sub-pixel among said plurality of sub-pixels by said current sensor comprises: sensing a sum of currents of said plurality of pixels, and the step of updating said compensation table in said memory according to said sensed current comprises: updating said compensation table according to said sum of currents.

14. The method according to claim 13, further comprising: selecting said plurality of sub-pixels to correspond to a predetermined area of said display panel.

15. The method according to claim 14, wherein the step of updating said compensation table in said memory according to said sensed current comprises: updating said compensation table according to the value of said sum of currents and a predetermined relationship, and said predetermined relationship is associated with said pre-determined area.

16. The method according to claim 13, wherein the step of sensing a current of at least one sub-pixel among said plurality of sub-pixels by said current sensor comprises: sensing said sum of currents at cathodes of said plurality of sub-pixels.

17. An OLED display, comprising:

a display panel comprising a plurality of sub-pixels;

a memory storing a compensation table containing information for Mura compensation, wherein said compensation table is initially established based on the characteristic of each sub-pixel and the average luminance of said plurality of sub-pixels; and a processing circuit, comprising:

a current sensor sensing a sum of currents of a group of sub-pixels among said plurality of sub-pixels, wherein said compensation table is updated according to said sensed current; and a processor generating compensated image data based on an image data and said updated compensation table;

wherein said display panel displays said compensated image data, by said plurality of sub-pixels including said at least one sub-pixel emitting light in response to said compensated image data, whereby Mura defect is compensated.

18. The OLED display according to claim 1, wherein the compensation table stored in the memory is established initially based on the luminance or current characteristic in response to a test signal provided to said at least one sub-pixel sensed by the current sensor.

19. The method according to claim 10, wherein the compensation table is established initially based on the luminance or current characteristic in response to a test signal provided to said at least one sub-pixel sensed by the current sensor.

* * * * *